US005399453A

United States Patent [19]

Dohi et al.

[11] Patent Number: 5,399,453

[45] Date of Patent: Mar. 21, 1995

[54] ELECTROPHOTOGRAHIC PHOTORECEPTOR

[75] Inventors: Kazuhito Dohi; Hajime Suzuki, both of Kofu; Tetsushi Shiozawa, Enzan; Yoichi Watanabe, Yamanashi, all of Japan

[73] Assignees: Yamanashi Electronics Co., Ltd., Yamanashi; Shindengen Electric Manufacturing Co., Ltd., Tokyo, both of Japan

[21] Appl. No.: 205,703

[22] Filed: Mar. 4, 1994

Related U.S. Application Data

[63] Continuation-in-part of Ser. No. 13,397, Feb. 4, 1993, abandoned.

[30] Foreign Application Priority Data

Feb. 14, 1992 [JP] Japan ..... 4-027902

[51] Int. Cl.[6] ..... G03G 5/06

[52] U.S. Cl. ..... 430/59; 430/72; 430/83

[58] Field of Search ..... 435/58, 59, 72, 83

[56] References Cited

U.S. PATENT DOCUMENTS

| | | | |
|---|---|---|---|
| 4,504,560 | 3/1985 | Takenouchi et al. | 430/72 |
| 4,933,245 | 6/1990 | Akasaki et al. | 430/59 |
| 5,139,910 | 8/1992 | Law et al. | 430/72 |

FOREIGN PATENT DOCUMENTS

| | | |
|---|---|---|
| 3911546 | 6/1964 | Japan . |
| 1118141A | 5/1989 | Japan . |

*Primary Examiner*—John Goodrow
*Attorney, Agent, or Firm*—Stevens, Davis, Miller & Mosher

[57] ABSTRACT

The invention provides an electrophotographic photoreceptor excellent in various characteristics, especially effectively protected from light fatigue and stable against repeated use. The photoreceptor comprises an electroconductive substrate having placed thereon a photosensitive layer which contains a bisazo compound of the formula [I]:

[I]

a diamine derivative of the formula [IV]:

[IV]

and a specific amount of a phenolic antioxidant, and the photoreceptor contains, if necessary, an intermediate layer between the electroconductive substrate and the photosensitive layer.

12 Claims, 2 Drawing Sheets

ELECTROPHOTOGRAHIC PHOTORECEPTOR

CROSS-REFERENCE TO RELATED APPLICATION

This is a continuation-in-part of application Ser. No. 08/013,397, filed on Feb. 4, 1993, now abandoned.

BACKGROUND OF THE INVENTION

The present invention relates to an electrophotographic photoreceptor which has a photosensitive layer comprising two organic materials of a specific bisazo compound and a specific diamine derivative as essential components.

Hitherto, inorganic materials such as selenium, selenium-tellurium, diarsenic triselenide, cadmium sulfide and amorphous silicon have been generally used as photoconductive materials of electrophotographic photoreceptors. These photoreceptors, however, are poor in flexibility for practical use, are susceptible to heat or mechanical shock and besides, are high in production cost. Recently, photoreceptors which are prepared using organic materials and free from these defects have been proposed and practically used. These organic photoreceptors generally include so-called function-separated type double-layered photoreceptors comprising an electroconductive substrate and a charge generation layer and a charge transport layer laminated on the substrate and function-combined type photoreceptors comprising an electroconductive substrate and a photosensitive layer which serves as both the two layers.

As the function-separated type photoreceptors, there have been known those which comprises a charge generation layer containing, for example, cyanine pigments or the like as an effective component and a charge transport layer containing organic compounds such as hydrazone compounds, pyrazoline compounds and oxadiazole compounds, these layers being laminated on a substrate. It is also known that many compounds are effective as charge generating agents and charge transporting agents.

In such function-separated type photoreceptors, a charge generator in the charge generation layer absorbs a light to generate a charge and the generated charge is injected into the charge transport layer and is transported through the charge transport layer. It is important to select materials for the charge transport layer in which the charge generator is not trapped by impurities or the like and can be transported to the surface. The electrophotographic characteristics of the function-separated type electrophotographic photoreceptor depend greatly upon the combination of the charge generating agent and the charge transporting agent.

However, it has been known as a result of experiments that a very few compounds can satisfy the characteristics and the conditions of photoreceptors required in practical use when they are used in combination for the charge generation layer and the charge transport layer. Especially, only a few of them satisfy the resisting characteristics against repetition of charging and exposing in the known electrophotographic process and when charging and exposing are repeatedly carried out, there is brought about increase in residual potential which is considered to be caused by accumulation of traps of the charge generator in the charge transport layer and as a result, the resulting images are apt to be fogged. These are presumed to be caused by light fatigue. These problems also occur in function-combined type single-layered photoreceptors prepared by dispersing a phthalocyanine pigment or a bisazo pigment in a binder resin and coating the dispersion on a substrate.

SUMMARY OF THE INVENTION

The inventors have conducted intensive research and repeated experiments for inhibition of light fatigue of photoreceptors after repeated use and for prevention of increase in residual potential due to the light fatigue. As a result, it has been found that the combination of a specific bisazo compound and a specific diamine derivative represented by the following formula [IV] gives extremely excellent characteristics as electrophotographic photoreceptors and the above-mentioned problems have been solved. Thus, the present invention has been accomplished.

The electrophotographic photoreceptor of the present invention is characterized by having a photosensitive layer which contains, as essential components, a bisazo compound represented by the following formula [I] and having a high charge generation efficiency as a charge generating agent and a diamine derivative represented by the following formula [IV] and having a high hole transport efficiency as a charge transporting agent.

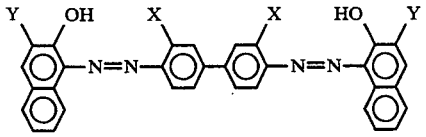

[I]

(wherein X' represents a hydrogen atom, a halogen atom, an alkyl group having 1 to 3 carbon atom or an alkoxy group having 1 to 3 carbon atoms and Y represents a group represented by one of the formula [II]—CONH—Ar and the formula [III]—CONHN=CH—Ar in which Ar represents a substituted or unsubstituted aromatic carbocyclic or aromatic heterocyclic group), and

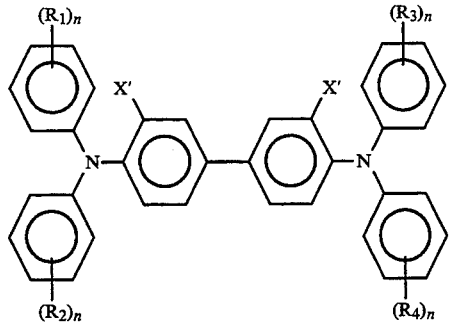

[IV]

(wherein X' represents a hydrogen atom, an alkyl group having 1 to 3 carbon atoms or an alkoxy group having 1 to 3 carbon atoms and each of $R_1$–$R_4$ represents a hydrogen atom, an alkyl group having 1 to 3 carbon atoms or an alkoxy group having 1 to 3 carbon atoms).

That is, it has been confirmed that when the above two components are contained, effective generation of charge and transporting of hole are brought about upon being exposed to incident light and the resulting organic photoreceptors have excellent characteristics.

DETAILED DESCRIPTION OF THE INVENTION

Figure 1:
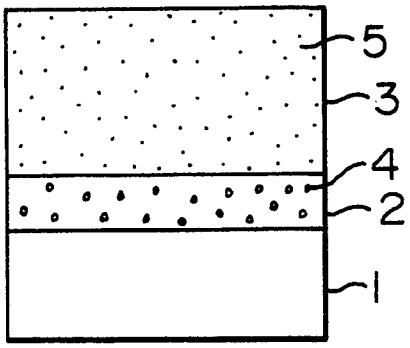
FIG. 1 is a sectional view of one example of the electrophotographic photoreceptor according to the present invention which has a negatively charging type function-separated double-layered structure.

The first characteristic of the charge generation layer used in the present invention is that it contains a bisazo pigment represented by the following formula [I]:

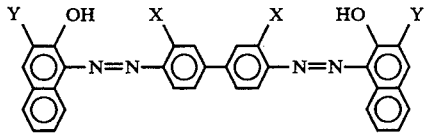

[I]

(wherein X represents a hydrogen atom, a halogen atom, an alkyl group or an alkoxy group and Y represents a group represented by one of the formula [II]—CONH—Ar or the formula [III]—CONHN=CH—Ar in which Ar represents a substituted or unsubstituted aromatic carbocyclic or aromatic heterocyclic group).

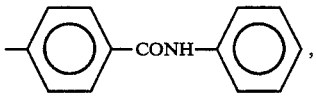

,

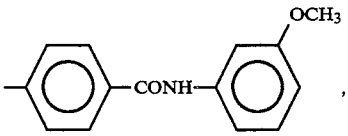

,

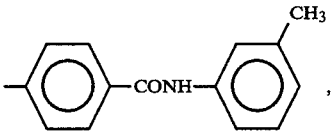

,

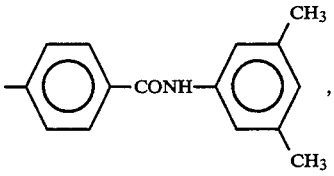

,

-continued

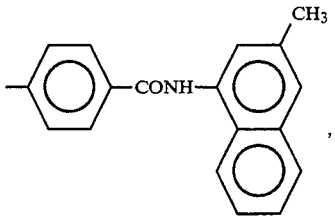

,

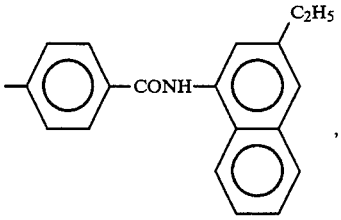

, and

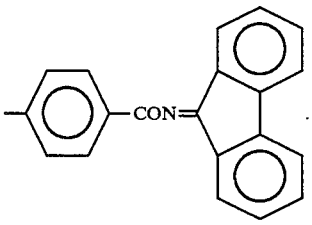

.

Examples of the bisazo compounds used in the present invention are as shown in Table 1.

TABLE 1

| Bisazo compounds of the formula [I] | | |
|---|---|---|
| | X | Ar |
| (1) | Cl | 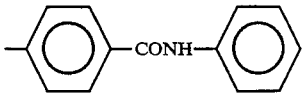 |
| (2) | Cl | 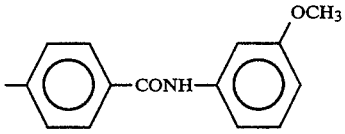 |
| (3) | Cl | 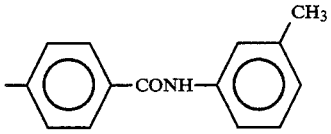 |
| (4) | Cl | 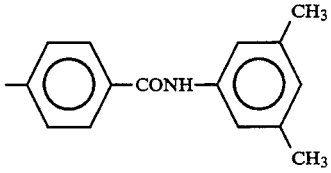 |

This charge generation layer can be formed by dispersing the above pigment in a binder solution and then coating the dispersion on a substrate. As the binder, there may be used, for example, polyvinyl butyral, polyvinyl acetal, polyesters, polycarbonates, polyamides, polyurethanes and phenolic resins. The content of the resin as the binder in the charge generation layer is generally 80% or less, preferably 50% or less and especially preferably 40% or less. As the solvents, there may be used alcohols, ethers such as dioxane, cyclohexanone and tetrahydrofuran, ketones such as acetone and methyl ethyl ketone, and chlorinated hydrocarbons such as dichloromethane, chloroform and carbon tetrachloride.

Total solid content of the bisazo compound and the binder in the solvent is preferably 0.5–5%, especially preferably 1–3%. The ratio of the bisazo compound and the binder is preferably 0.5/1–5/1, more preferably 1/1–3/1.

The dispersion of the pigment can be obtained by dry kneading and grinding the bisazo compound and the binder by known methods using a ball mill, an attritor and others and then, continuously dispersing the powders together with a solvent using a dispersing apparatus such as a sand mill. The coating methods of the resulting pigment dispersion and the coating methods for formation of the charge transport layer include, for example, blade coating, Meyer bar coating, spray coating, dip coating, curtain coating and bead coating. The thickness of the charge generation layer is generally 5μ or less, preferably 0.1–2μ.

Another characteristic of the present invention is to use a charge transport layer containing a specific diamine derivative, namely, a diamine derivative represented by the following formula [IV] together with the charge generation layer containing the bisazo pigment.

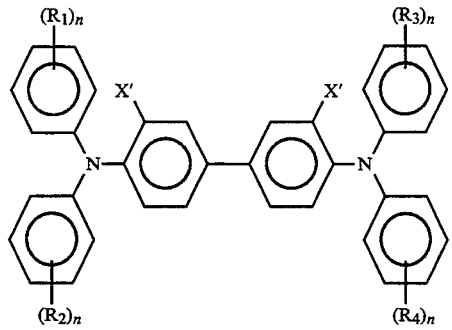

[IV]

(wherein X' represents a hydrogen atom, an alkyl group or an alkoxy group and each of $R_1$–$R_4$ represent a hydrogen atom, an alkyl group or an alkoxy group).

It is preferable that each of the 4 n's is independently an integer of 0 to 5 and each of $R_1$–$R_4$ is independently an alkyl group having 1 to 3 carbon atoms or an alkoxy group having 1 to 3 carbon atoms, and more preferable that each of the 4 n's is independently an integer of 1 or 2 and each of $R_1$–$R_4$ is independently an alkyl having 1 to 3 carbon atoms or an alkoxy group having 1 to 3 carbon atoms.

Examples of the diamine derivatives represented by the formula [IV] are shown in the following Table 2.

TABLE 2

| Compd. No. | X' | R1 | R2 | R3 | R4 |
|---|---|---|---|---|---|
| | | Diamine derivatives of the formula [IV] | | | |
| (1) | H | H | H | H | H |
| (2) | H | 4-$CH_3$ | H | 4-$CH_3$ | H |
| (3) | H | 2-$CH_3$ | H | 2-$CH_3$ | H |
| (4) | H | 2-$CH_3$ | H | H | 2-$CH_3$ |
| (5) | H | 2,4-di $CH_3$ | H | 2,4-di $CH_3$ | H |
| (6) | H | 2,4-di $CH_3$ | H | H | 2,4-di $CH_3$ |
| (7) | H | 2,4,6-tri $CH_3$ | H | 2,4,6-tri $CH_3$ | H |
| (8) | H | 2,4,6-tri $CH_3$ | H | H | 2,4,6-tri $CH_3$ |
| (9) | H | 2-$CH_3$ | 2-$CH_3$ | 2-$CH_3$ | 2-$CH_3$ |
| (10) | H | 2,4-di $CH_3$ | 2,4-di $CH_3$ | 2,4-di $CH_3$ | 2,4-di $CH_3$ |
| (11) | H | 2,4,6-tri $CH_3$ | 2,4,6-tri $CH_3$ | 2,4,6-tri $CH_3$ | 2,4,6-tri $CH_3$ |
| (12) | H | 2,3,4,5,6 penta $CH_3$ | 2,3,4,5,6 penta $CH_3$ | 2,3,4,5,6 penta $CH_3$ | 2,3,4,5,6 penta $CH_3$ |
| (13) | $CH_3$ | H | H | H | H |
| (14) | $CH_3$ | 4-$C_2H_5$ | H | 4-$C_2H_5$ | H |
| (15) | $CH_3$ | 2-$C_2H_5$ | H | 2-$C_2H_5$ | H |
| (16) | $CH_3$ | 2-$C_2H_5$ | H | H | 2-$C_2H_5$ |
| (17) | $CH_3$ | 2,4-di $C_2H_5$ | H | 2,4-di $C_2H_5$ | H |
| (18) | $CH_3$ | 2,4-di $C_2H_5$ | H | H | 2,4-di $C_2H_5$ |
| (19) | $CH_3$ | 2,4,6-tri $C_2H_5$ | H | 2,4,6-tri $C_2H_5$ | H |
| (20) | $CH_3$ | 2,4,6-tri $C_2H_5$ | H | H | 2,4,6-tri $C_2H_5$ |
| (21) | $CH_3$ | 2-$C_2H_5$ | 2-$C_2H_5$ | 2-$C_2H_5$ | 2-$C_2H_5$ |
| (22) | $CH_3$ | 2,4-di $C_2H_5$ | 2,4-di $C_2H_5$ | 2,4-di $C_2H_5$ | 2,4-di $C_2H_5$ |
| (23) | $CH_3$ | 2,4,6-tri $C_2H_5$ | 2,4,6-tri $C_2H_5$ | 2,4,6-tri $C_2H_5$ | 2,4,6-tri $C_2H_5$ |
| (24) | $CH_3$ | 2,3,4,5,6 penta $C_2H_5$ | 2,3,4,5,6 penta $C_2H_5$ | 2,3,4,5,6 penta $C_2H_5$ | 2,3,4,5,6 penta $C_2H_5$ |
| (25) | $OCH_3$ | H | H | H | H |
| (26) | $OCH_3$ | 4-$OCH_3$ | H | 4-$OCH_3$ | H |
| (27) | $OCH_3$ | 2-$OCH_3$ | H | 2-$OCH_3$ | H |
| (28) | $OCH_3$ | 2-$OCH_3$ | H | H | 2-$OCH_3$ |
| (29) | $OCH_3$ | 2,4-di $OCH_3$ | H | 2,4-di $OCH_3$ | H |
| (30) | $OCH_3$ | 2,4-di $OCH_3$ | H | H | 2,4-di $OCH_3$ |
| (31) | $OCH_3$ | 2,4,6-tri $OCH_3$ | H | 2,4,6-tri $OCH_3$ | H |
| (32) | $OCH_3$ | 2,4,6-tri $OCH_3$ | H | H | 2,4,6-tri $OCH_3$ |
| (33) | $OCH_3$ | 2-$OCH_3$ | 2-$OCH_3$ | 2-$OCH_3$ | 2-$OCH_3$ |
| (34) | $OCH_3$ | 2,4-di $OCH_3$ | 2,4-di $OCH_3$ | 2,4-di $OCH_3$ | |
| (35) | $OCH_3$ | 2,4,6-tri $OCH_3$ | 2,4,6-tri $OCH_3$ | 2,4,6-tri $OCH_3$ | 2,4,6-tri $OCH_3$ |
| (36) | $OCH_3$ | 2,3,4,5,6 penta $OCH_3$ | 2,3,4,5,6 penta $OCH_3$ | 2,3,4,5,6 penta $OCH_3$ | 2,3,4,5,6 penta $OCH_3$ |
| (37) | $C_2H_5$ | H | H | H | H |
| (38) | $C_2H_5$ | 4-$OC_2H_5$ | H | 4-$OC_2H_5$ | H |
| (39) | $C_2H_5$ | 2-$OC_2H_5$ | H | 2-$OC_2H_5$ | H |

TABLE 2-continued

| Compd. No. | X' | R1 | R2 | R3 | R4 |
|---|---|---|---|---|---|
| | | Diamine derivatives of the formula [IV] | | | |
| (40) | $C_2H_5$ | 2-$OC_2H_5$ | H | H | 2-$OC_2H_5$ |
| (41) | $C_2H_5$ | 2,4-di $OC_2H_5$ | H | 2,4-di $OC_2H_5$ | H |
| (42) | $C_2H_5$ | 2,4-di $OC_2H_5$ | H | H | 2,4-di $OC_2H_5$ |
| (43) | $OC_2H_5$ | 2,4,6-tri $C_2H_5$ | H | 2,4,6-tri $C_2H_5$ | H |
| (44) | $OC_2H_5$ | 2,4,6-tri $C_2H_5$ | H | H | 2,4,6-tri $C_2H_5$ |
| (45) | $OC_2H_5$ | 2-$C_2H_5$ | 2-$C_2H_5$ | 2-$C_2H_5$ | 2-$C_2H_5$ |
| (46) | $OC_2H_5$ | 2,4-di $C_2H_5$ | 2,4-di $C_2H_5$ | 2,4-di $C_2H_5$ | 2,4-di $C_2H_5$ |
| (47) | $OC_2H_5$ | 2,4,6-tri $C_2H_5$ | 2,4,6-tri $C_2H_5$ | 2,4,6-tri $C_2H_5$ | 2,4,6-tri $C_2H_5$ |
| (48) | $OC_2H_5$ | 2,3,4,5,6 penta $C_2H_5$ | 2,3,4,5,6 penta $C_2H_5$ | 2,3,4,5,6 penta $C_2H_5$ | 2,3,4,5,6 penta $C_2H_5$ |

It is preferred to form the charge transport layer by coating a solution prepared by dissolving the diamine derivative represented by the formula [IV] and the binder in a suitable solvent and drying the coat.

The binder and the solvent may be the same as those used for preparing the coating solution of the above bisazo compound. The ratio of the diamine derivative and the binder in the solvent is preferably 0.3/1–2/1, more preferably 0.5/1–1.5/1. The thickness of the charge transport layer is preferably 5–30 μm, more preferably 15–25 μm.

The charge transport layer of the present invention can contain various additives. Examples of the additives are phenolic antioxidants such as 2-tert-butyl-4-methoxyphenol, 2,6-di-tert-butylphenol, 2,6-di-tert-butyl-4-methylphenol, 2,6-di-tert-butyl-4-ethylphenol and 2,6-di-tert-butyl-4-phenol. These phenolic antioxidants inhibit generation of cracks caused by oils or fingerprints left on the surface of the photoreceptor without damaging basic characteristics of photoreceptors and improve ozone resistance and coating stability and further improve resistance against repeated use and light fatigue resistance as electrophotographic photoreceptors.

The antioxidants having a molecular weight of 200–1000 are especially effective. The amount of the phenolic antioxidant dissolved is preferably 1–20% by weight based on the diamine derivative in the coating solution. If it is less than 1% by weight, cracks occur and if it is more than 20% by weight, the residual potential increases.

Also, the charge transport layer of the present invention can contain at least one electrophotoacceptor. Examples of the electrophotoacceptor are compounds represented by formulas [V]-(1)–[V]-(3).

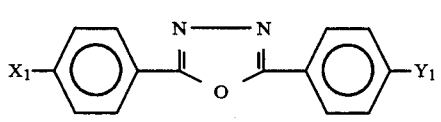

[V]-(1)

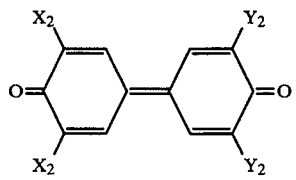

[V]-(2)

-continued

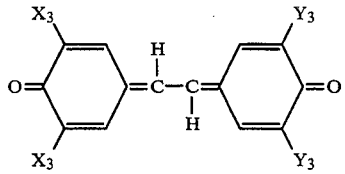

[V]-(3)

(wherein each of $X_1$ and $Y_1$ represents an alkyl group, an alkoxy or an alkylamino group, each of $X_2$ and $Y_2$ represents an alkyl group or an alkoxy group and each of $X_3$ and $Y_3$ represents an alkyl group or an alkoxy group) The proportion of the electrophotoacceptor is 3% by weight or less, preferably 0.2%–2% by weight, based on the weight of the charge transporting agent in the charge transport layer.

Various layer structures of electrophotographic photoreceptors are known and the electrophotographic photoreceptor of the present invention can also have any of the layer structures. The structures will be explained referring to the accompanying FIGS. 1–6.

Figure 2:
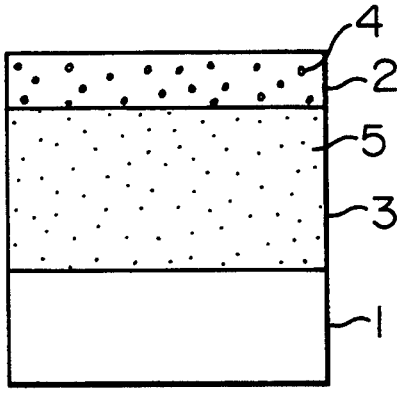
FIG. 2 is a sectional view of another example of the electrophotographic photoreceptor according to the present invention which has a positively charging type function-separated double-layered structure.
Figure 3:
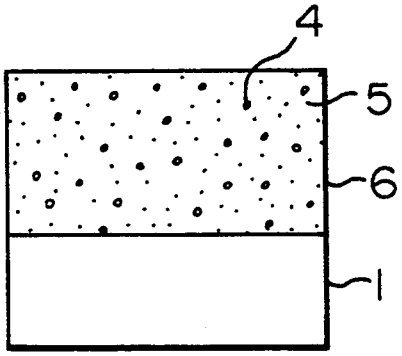
FIG. 3 is a sectional view of further another example of the electrophotographic photoreceptor according to the present invention which has a both polarity type single-layered structure.

FIG. 1 illustrates a negative charging type function-separated double-layered structure which comprises an electroconductive substrate 1, a charge generation layer 2 mainly composed of the above-mentioned bisazo compound which is formed on the substrate 1 and a charge transport layer 3 mainly composed of the above-mentioned diamine derivative which is formed on the charge generation layer 2. FIG. 2 illustrates a positive charging type function-separated type double-layered structure which corresponds to that of FIG. 1 where the position of the charge generation layer and that of the charge transport layer are reversed. FIG. 3 illustrates a both polarity type single-layered structure which has a photosensitive layer 6 in which the charge generating agent 4 and the charge transporting agent 5 are mixed and dispersed.

Figure 4:
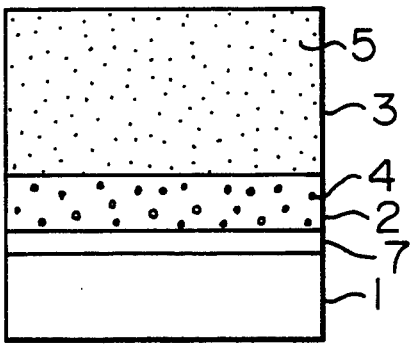
FIGS. 4–6 are sectional views of other examples of the electrophotographic photoreceptor according to the present invention which has an intermediate layer between the electroconductive substrate and the structures of FIGS. 1–3, respectively.
Figure 5:
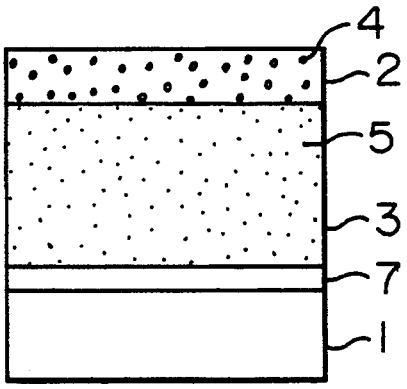
Figure 6:
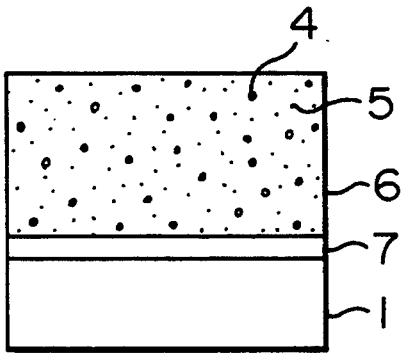

Furhtermore, in the photoreceptor of the present invention, if necessary, an intermediate layer 7 may be provided on the electroconductive substrate as shown in FIGS.4-6 in order to inhibit injection of free charge into the photosensitive layer from the electroconductive substrate at the time of charging of the photosensitive layer and to obtain an action as an adhesive layer for allowing the photosensitive layer to adhere integrally to the electroconductive substrate and holding the photosensitive layer. This intermediate layer may be composed of aluminum oxide, indium oxide, tin oxide, polyethylene, acrylic resins, epoxy resins, polycarbonates, polyurethanes, vinyl chloride resin, vinyl acetate resin, polyvinyl alcohol, polyamide resin, urethane resin or the like. These may be used each alone or in admixture. The thickness of this intermediate layer or adhesive layer is preferably 0.1–5 μm, more preferably 0.5–3 μm.

As the electroconductive substrate used in the electrophotographic photoreceptor of the present invention, there may be used any materials as far as they have electroconductivity. Examples of these materials are metals such as aluminum, copper, stainless steel and brass and plastics on which tin oxide or the like is vapor deposited or laminated. The electroconductive substrate may be in the form of a sheet, a belt, a drum or the like.

The electrophotographic photoreceptors of the present invention have the above-mentioned constructions and are effectively protected from light fatigue and stable in resistance against repeated use and have a high photosensitivity as is clear from the examples given hereinafter. That is, they are excellent in charging characteristics, sensitivity characteristics and image characteristics and especially they undergo no deterioration due to fatigue even after repeated use and are excellent in endurance. Thus, the present invention is very useful.

The following examples are set forth for purposes of illustration so that the invention can be better understood. It should be understood that they are exemplary only, and should not be construed as limiting the invention in any manner.

EXAMPLE 1

The bisazo compound [I]-(1) shown in Table 1 and polyvinyl butyral at a weight ratio of 2/1 were dry kneaded and dispersed in a solvent consisting of dioxane and acetone at a volume ratio of 8/2 for 10 hours by a sand mill to obtain a coating solution A having a solid content of 10% by weight. This coating solution A was coated on an aluminum drum substrate by dip coating method and dried to form a charge generation layer. Thickness of this layer was 0.3μ.

Then, the diamine derivative [IV]-(1) shown in Table 2 {N,N,N',N'-tetraphenylbenidine} and polycarbonate at a weight ratio of 1/1 were dissolved in dichloromethane to obtain a solution having a solid content of 25% by weight. Furthermore, 10% by weight based on the weight of the diamine derivative of an antioxidant 2,6-di-tert-butyl-4-methylphenol as an additives was dissolved in the above solution to obtain a coating solution B. This coating solution B was coated on the charge generation layer by dip coating method and dried to form a charge transport layer. The thickness of the layer was 21 μm.

The resulting photoreceptor was subjected to corona discharging of −5 kv. The surface potential at that time was measured (initial potential $V_0$). Further, after this photoreceptor was left in the dark for 10 seconds, the surface potential was measured (V10) to determine the value $V_{10}/V_0$ which was taken as a dark decay DDR.

The sensitivity was evaluated by measuring the exposure (T/2, lux-sec) required for one-half decay of a surface potential −700 V. A halogen lamp (wavelength 780 nm) was used as a light source. The results are shown in Table 3.

EXAMPLE 2

A photoreceptor was produced in the same manner as in Example 1 except that the diamine derivative [IV]-(5) shown in Table 2 {4,4'-bis[N](2,4-dimethylphenyl)-N-phenylamino]diphenyl} was used in place of the bisazo compound [IV]-(1). Photographic characteristics of the resulting photoreceptor were measured in the same manner as in Example 1 to obtain the results shown in Table 3.

EXAMPLE 3

A photoreceptor was produced in the same manner as in Example 1 except that the diamine derivative [IV]-(8) shown in Table 2 {4,4'-bis[N-2,4,6-trimethylphenyl)-N-phenylamino]diphenyl} was used in place of the diamine derivative [IV]-(1). Photographic characteristics of the resulting photoreceptor were measured in the same manner as in Example 1 to obtain the results shown in Table 3.

EXAMPLE 4

A photoreceptor was produced in the same manner as in Example 1 except that the diamine derivative [IV]-(13) shown in Table 2 {N,N,N',N'-tetraphenyl-3,3'-dimethylbenzidine} was used in place of the diamine derivative [IV]-(1). Photographic characteristics of the resulting photoreceptor were measured in the same manner as in Example 1 to obtain the results shown in Table 3.

EXAMPLE 5

A photoreceptor was produced in the same manner as in Example 1 except that the diamine derivative [IV]-(17) shown in Table 2 {N,N '-diphenyl-N,N '-di(2,4-diethylphenyl)-3,3'-dimethylbenzidine} was used in place of the diamine derivative [IV]-(1). Photographic characteristics of the resulting photoreceptor were measured in the same manner as in Example 1 to obtain the results shown in Table 3.

EXAMPLE 6

A photoreceptor was produced in the same manner as in Example 1 except that the diamine derivative [IV]-(20) shown in Table 2 {N,N'-diphenyl-N,N'-di(2,4,6-triethylphenyl)-3,3'-dimethylbenzidine} was used in place of the diamine derivative [IV]-(1). Photographic characteristics of the resulting photoreceptor were measured in the same manner as in Example 1 to obtain the results shown in Table 3.

EXAMPLE 7

A photoreceptor was produced in the same manner as in Example 1 except that the diamine derivative [IV]-(25) shown in Table 2 {N,N,N',N'-tetraphenyl-3,3'-dimethoxybenzidine} was used in place of the diamine derivative [IV]-(1). Photographic characteristics of the resulting photoreceptor were measured in the same manner as in Example 1 to obtain the results shown in Table 3.

EXAMPLE 8

A photoreceptor was produced in the same manner as in Example 1 except that the diamine derivative [IV]-(29) shown in Table 2 {N,N'-diphenyl-N,N'-di(2,4-dimethylphenyl)-3,3'-dimethylbenzidine} was used in place of the diamine derivative [IV]-(1). Photographic characteristics of the resulting photoreceptor were measured in the same manner as in Example 1 to obtain the results shown in Table 3.

EXAMPLE 9

A photoreceptor was produced in the same manner as in Example 1 except that the diamine derivative [IV]-(32) shown in Table 2 {N,N'-diphenyl-N,N'-di(2,4,6-trimethoxy)-phenyl-3,3'-dimethylbenzidine} was used in place of the diamine derivative [IV]-(1). Photographic characteristics of the resulting photoreceptor were measured in the same manner as in Example 1 to obtain the results shown in Table 3.

EXAMPLE 10

A photoreceptor was produced in the same manner as in Example 1 except that the diamine derivative [IV]-(37) shown in Table 2 {N,N,N',N'-tetraphenyl-3,3'-diethylbenzidine} was used in place of the diamine derivative [IV]-(1). Photographic characteristics of the resulting photoreceptor were measured in the same manner as in Example 1 to obtain the results shown in Table 3.

EXAMPLE 11

A photoreceptor was produced in the same manner as in Example 1 except that the diamine derivative [IV]-(41) shown in Table 2 {N,N'-diphenyl-N,N'-di(2,4-diethoxy)-phenyl-3,3'-diethylbenzidine} was used in place of the diamine derivative [IV]-(1). Photographic characteristics of the resulting photoreceptor were measured in the same manner as in Example 1 to obtain the results shown in Table 3.

EXAMPLE 12

A photoreceptor was produced in the same manner as in Example 1 except that the diamine derivative [IV]-(44) shown in Table 2 {N,N'-diphenyl-N,N'-di(2,4,6-triethyl)-phenyl-3,3'-diethoxybenzidine} was used in place of the diamine derivative [IV]-(1). Photographic characteristics of the resulting photoreceptor were measured in the same manner as in Example 1 to obtain the results shown in Table 3.

EXAMPLE 13

A photoreceptor was produced in the same manner as in Example 1 except that the bisazo compound [I]-(2) shown in Table 1 was used in place of the bisazo compound [I]-(1) and the diamine derivative [IV]-(5) shown in Table 2 {4,4'-bis[N-(2,4-dimethylphenyl)-N-phenylamino]diphenyl} was used in place of the diamine derivative [IV]-(1). Photographic characteristics of the resulting photoreceptor were measured in the same manner as in Example 1 to obtain the results shown in Table 3.

EXAMPLE 14

A photoreceptor was produced in the same manner as in Example 1 except that the bisazo compound [I]-(3) shown in Table 1 was used in place of the bisazo compound [I]-(1) and the diamine derivative [IV]-(8) shown in Table 2 {4,4'-bis[N-(2,4,6-trimethylphenyl)-N-phenylamino]diphenyl} was used in place of the diamine derivative [IV]-(1). Photographic characteristics of the resulting photoreceptor were measured in the same manner as in Example 1 to obtain the results shown in Table 3.

EXAMPLE 15

A polyamide resin having the following formula (TRESIN F 30 manufactured by Teikoku Kagaku Sangyo Co., Ltd.) was coated at a thickness of 5 μm on an aluminum drum by dip coating method to form an intermediate layer. Thereafter, a photoreceptor was prepared and photographic characteristics were measured in the same manner as in Example 1 to obtain the results shown in Table 3.

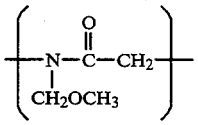

EXAMPLE 16

A photoreceptor was produced in the same manner as in Example 1, except that an electrophotoacceptor having the formula [V]-(2) in which $X_2$ is t-butyl and $Y_2$ is methyl was added together with the diamine derivative [IV]-(5) used in Example 2, in proportion of 1% by weight based on the weight of the diamine derivative.

Photographic characteristics of the resulting photoreceptor were measured in the same manner as in Example 1 to obtain the results shown in Table 3.

COMPARATIVE EXAMPLE 1

A photoreceptor was produced in the same manner as in Example 1 except that the known charge transporting compound No. 1 shown in Table 4 was used in place of the diamine derivative [IV]-(1).

COMPARATIVE EXAMPLE 2

A photoreceptor was produced in the same manner as in Example 1 except that the known charge transporting compound No. 3 shown in Table 4 was used in place of the diamine derivative [IV]-(1).

COMPARATIVE EXAMPLE 3

A photoreceptor was produced in the same manner as in Example 1 except that the known charge transporting compound No. 5 shown in Table 4 was used in place of the diamine derivative [IV]-(1).

COMPARATIVE EXAMPLE 4

A photoreceptor was produced in the same manner as in Example 1 except that the known charge transporting compound No. 7 shown in Table 4 was used in place of the diamine derivative [IV]-(1).

COMPARATIVE EXAMPLE 5

A photoreceptor was produced in the same manner as in Example 1 except that a bisazo compound represented by the following structural formula was used in place of the bisazo compound [I]-(1), and the photographic characteristics of the resulting photoreceptor were measured in the same manner as in Example 1 to obtain the results shown in Table 3.

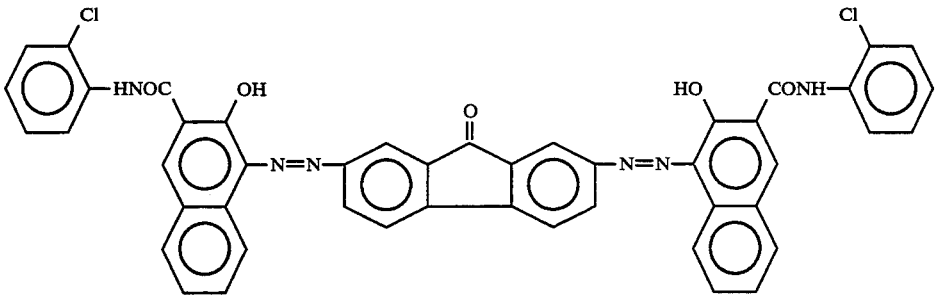

2,7-Bis[2-hydroxy-3-(2-chlorophenylcarbamoyl)-1-naphthylazo-9-fluorenone.

COMPARATIVE EXAMPLE 6

A photoreceptor was produced in the same manner as in Example 1 except that Chlorinated Dian Blue represented by the following structural formula was used in place of the bisazo compound [I]-(1), and photographic characteristics of the resulting photoreceptor were measured in the same manner as in Example 1 to obtain the results shown in Table 3:

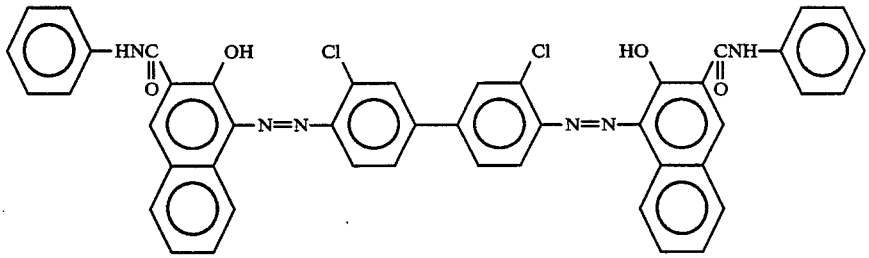

Chlorinated Dian Blue.

COMPARATIVE EXAMPLE 7

A photoreceptor was produced in the same manner as in Example 1 except that p-diethylaminobenzaldehyde-(diphenylhydrazone) represented by the following structural formula was used in place of the diamine derivative [IV]-(2), and photographic characteristics of the resulting photoreceptor were measured in the same manner as in Example 1 to obtain the results shown in Table 3:

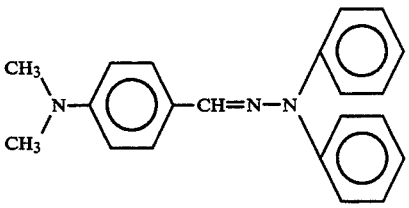

p-Dimethylaminobenzaldehyde-(diphenylhydrozone).

TABLE 3

| | V0 | DDR % | VR | T/2 | Cracking |
|---|---|---|---|---|---|
| Example 1 | 700 | 90 | 20 | 0.5 | No |
| Example 2 | 700 | 90 | 20 | 0.7 | No |
| Example 3 | 700 | 90 | 20 | 0.7 | No |
| Example 4 | 700 | 90 | 20 | 0.8 | No |
| Example 5 | 700 | 90 | 20 | 0.8 | No |
| Example 6 | 700 | 90 | 20 | 0.8 | No |
| Example 7 | 700 | 95 | 40 | 0.8 | No |
| Example 8 | 700 | 95 | 40 | 0.8 | No |
| Example 9 | 700 | 95 | 40 | 0.8 | No |
| Example 10 | 700 | 95 | 50 | 0.7 | No |
| Example 11 | 700 | 95 | 50 | 0.7 | No |
| Example 12 | 700 | 95 | 50 | 0.7 | No |
| Example 13 | 700 | 90 | 20 | 0.7 | No |
| Example 14 | 700 | 90 | 25 | 0.9 | No |
| Example 15 | 720 | 95 | 40 | 0.8 | No |
| Example 16 | 710 | 95 | 30 | 0.8 | No |
| Comp. Example 1 | 680 | 75 | 60 | 1.3 | No |
| Comp. Example 2 | 700 | 90 | 80 | 2.4 | No |
| Comp. Example 3 | 680 | 90 | 80 | 2.5 | No |
| Comp. Example 4 | 700 | 70 | 90 | 2.7 | No |
| Comp. Example 5 | 650 | 70 | 100 | 3.5 | No |
| Comp. Example 6 | 700 | 65 | 200 | 4.5 | No |
| Comp. Example 7 | 680 | 75 | 60 | 2.3 | No |

V0: Surface potential (−5 kv)
DDR: Dark decay (Surface potential measured after the photoreceptor was left to stand in the dark for 10 seconds)
VR: Residential potential (The photoreceptor was subjected to repetition of charging and discharging with irradiation of a white light of 300 lux and residual potential was measured after discharging of the 100th cycle, one cycle consisting of charging and discharging.)
T/2: Half decay exposure (Exposure required for one-half decay of the surface potential −700 V)
Cracks: The surface of the photoreceptor was applied with oil, fingerprints or the like and after elapse of 48 hours, the surface was visually examined.

TABLE 4
Known charge transporting compounds
No. 1
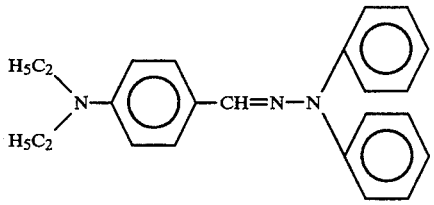
No. 2
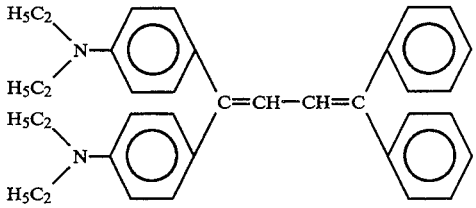
No. 3
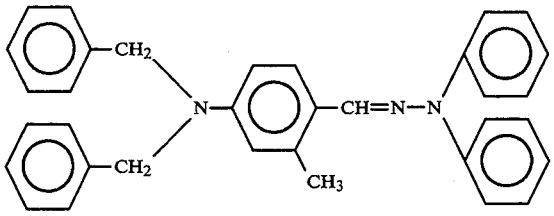
No. 4
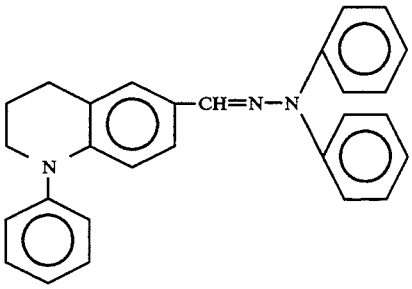
No. 5
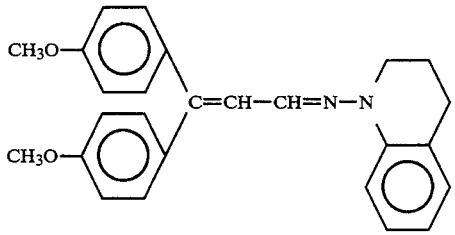
No. 6
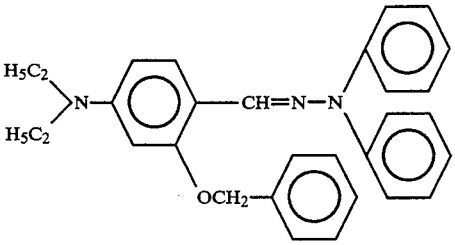
No. 7
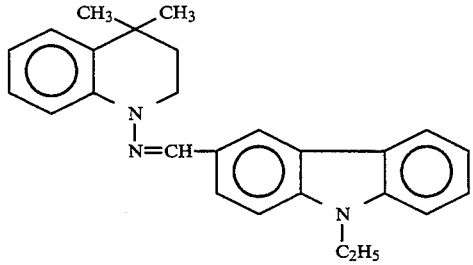
No. 8
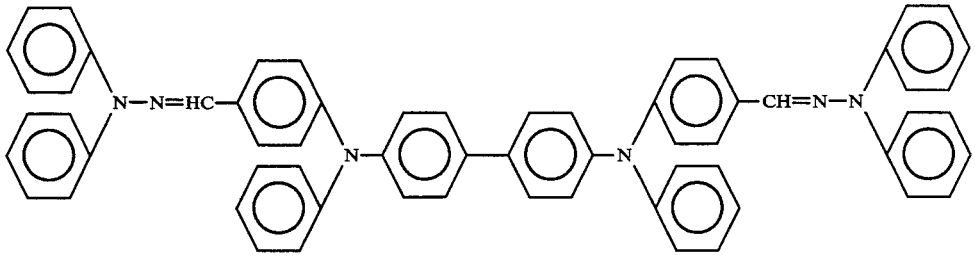
No. 9
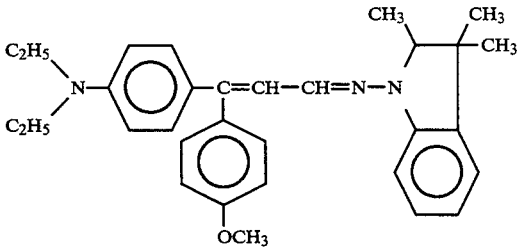

TABLE 4-continued

Known charge transporting compounds

No. 10

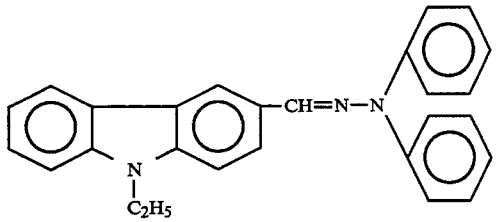

No. 11

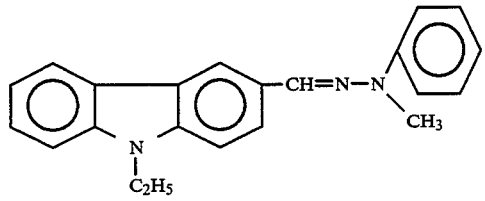

No. 12

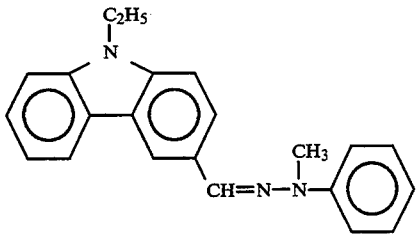

As can be seen from Table 3, the electrophotographic photoreceptors obtained in Comparative Examples 1–5 were all low in sensitivity and high in residual potential while the electrophotographic photoreceptors obtained in Examples 1 to 16 were all high in sensitivity and low in residual potential. Furthermore, the photoreceptor of Example 15 which was provided with the intermediate layer had no defects in images such as fogging and black points caused by reversal development and was improved in image quality.

Also, the photoreceptor of Example 5 in which the electrophotoacceptor was contained in the charge transport layer had the characteristics that no deterioration occurs owing to light fatigue and sensitivity is kept.

The reason why the sensitivity of the electrophotographic photoreceptors of Examples 1–5 was high is considered to be as follows.

In general, organic electrophotographic photoreceptors can be classified to the above-mentioned single-layered type and double-layered type. In the case of the single-layered type, the whole area of the photosensitive layer absorbs the light to produce a charge pair (hole and electron) and these are separated in the electric field and reach counter electrodes, thereby to decay the charge.

In the case of the double-layered type of Examples 1 to 16, the function of the charge generation layer and that of the charge transport layer is separated. When the charge generation layer absorbs a light, a charge pair is produced and under the electric field, in the case of being negatively charged, the hole is injected into the charge transport layer and transported through the charge transport layer and thus, the charge is decayed. Accordingly, there is present very small interface (energy barrier) with the charge generation layer when the hole is injected into the charge transporting agent [IV] of Examples 1 to 16 and injection efficiency of hole is high.

The "%" and the ratio used here are by weight.

What is claimed is:

1. An organic electrophotographic photoreceptor which comprises an electroconductive substrate having placed thereon a photosensitive layer, said layer containing a bisazo compound represented by the formula (I) and a diamine derivative represented by the formula (IV):

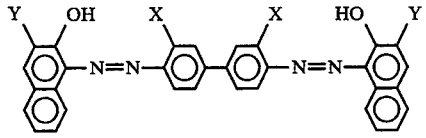

(I)

wherein X represents a hydrogen atom, a halogen atom, an alkyl group having 1 to 3 carbon atoms or an alkoxy group having 1 to 3 carbon atoms and Y represents a group represented by one of the formula (II) —CONH—Ar and the formula (III) —CONHN=CH—Ar in which Ar represents a group selected from

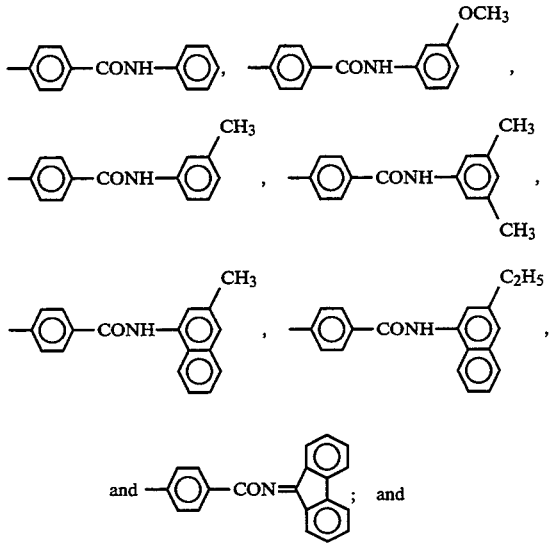

-continued

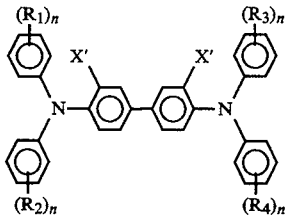

(IV)

wherein X' represents a hydrogen atom, an alkyl group having 1 to 3 carbon atoms or an alkoxy group having 1 to 3 carbon atoms; each n represents independently an integer of 0–5 and each of $R_1$–$R_4$ represents independently a hydrogen atom, an alkyl group or an alkoxy group having 1 to 3 carbon atoms.

2. An organic electrophotographic photoreceptor according to claim 1, wherein X represents a chlorine atom.

3. An organic electrophotographic photoreceptor according to claim 1, wherein X' represents a hydrogen atom or a methyl, ethyl, methoxy or ethoxy group, and each of $R_1$–$R_4$ represents hydrogen or a methyl, ethyl, methoxy or ethoxy group.

4. An organic electrophotographic photoreceptor according to claim 1, wherein the photosensitive layer additionally contains a phenolic antioxidant in an amount of 1–20% by weight based on weight of the diamine derivative represented by the formula [IV].

5. An organic electrophotographic photoreceptor according to claim 1, wherein an intermediate layer is present between the electroconductive substrate and the photosensitive layer.

6. An organic electrophotographic photoreceptor according to claim 5, wherein the intermediate layer is composed of at least one compound selected from the group consisting of aluminium oxide, indium oxide, tin oxide, polyethylene, acrylic resins, epoxy resins, polycarbonates, polyurethanes, vinyl chloride resin, vinyl acetate resin, polyvinyl alcohol, polyamide resin and urethane resin.

7. An organic electrophotographic photoreceptor according to claim 1, wherein the photosensitive layer contains a charge transporting agent and an electrophotoacceptor in a proportion of 3% by weight or less based on the weight of the charge transporting agent.

8. An organic electrophotographic photoreceptor according to 7, wherein the electrophotoacceptor is at least one compound selected from the group consisting of compounds represented by formulas [V]-(1)–[V]-(3):

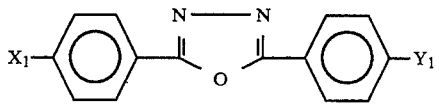

[V]-(1)

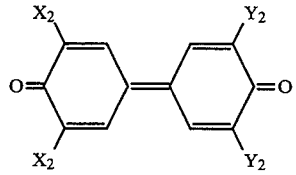

[V]-(2)

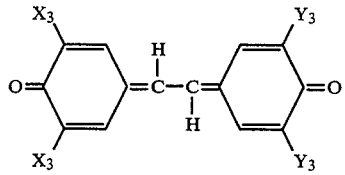

[V]-(3)

(wherein each of $X_1$ and $Y_1$ represents independently an alkyl group, an alkoxy group or an alkyl amino group, each of $X_2$ and $Y_2$ represents independently an alkyl group or an alkoxy group and each of $X_3$ and $Y_3$ represents independently an alkyl group or an alkoxy group).

9. An organic electrophotographic photoreceptor according to claim 1, wherein each n represents 2.

10. An organic electrophotographic photoreceptor according to claim 9, wherein each of $R_1$–$R_4$ represents independently a methyl or methoxy group.

11. An organic electrophotographic photoreceptor according to claim 1, wherein each n represents independently 1 or 2.

12. An organic electrophotographic photoreceptor according to claim 11, wherein each of $R_1$–$R_4$ represents independently a methyl, ethyl, methoxy or ethoxy group.

* * * * *